United States Patent [19]

Carlson

[11] Patent Number: 4,958,800

[45] Date of Patent: Sep. 25, 1990

[54] LOCKING HINGE MECHANISM

[75] Inventor: Michael G. Carlson, Lenexa, Kans.

[73] Assignee: Western Forms, Inc., Kansas City, Mo.

[21] Appl. No.: 376,318

[22] Filed: Jul. 6, 1989

[51] Int. Cl.[5] ..... E05D 11/10; E04G 17/04

[52] U.S. Cl. ..... 249/219.1; 16/223; 16/341; 16/353; 16/374; 249/48; 249/170; 249/171; 249/185

[58] Field of Search ..... 249/1, 13, 18, 48, 50, 249/51, 170, 171, 172, 185, 189, 192, 193, 194, 196, 210, 219.1; 16/223, 341, 349, 353, 374, 375

[56] References Cited

U.S. PATENT DOCUMENTS

| | | | |
|---|---|---|---|
| 791,585 | 6/1905 | Schuller | 249/48 |
| 953,383 | 3/1910 | Holman | 249/34 |
| 1,078,363 | 11/1913 | Lisicke | 16/374 |
| 1,159,184 | 11/1915 | Dale | 249/188 |
| 1,455,550 | 5/1923 | Rodell | 16/375 |
| 1,683,814 | 9/1928 | Block | 16/353 |
| 3,357,673 | 12/1967 | Williams | 249/194 |
| 3,507,473 | 4/1970 | Blonde | 249/171 |
| 3,519,242 | 7/1970 | Harkins | 249/48 |
| 3,724,801 | 4/1973 | Sels et al. | 249/48 |
| 3,917,216 | 11/1975 | Plaugh | 249/48 |
| 4,003,543 | 1/1977 | Doubleday et al. | 249/48 |

FOREIGN PATENT DOCUMENTS

| | | | |
|---|---|---|---|
| 2514392 | 4/1983 | France | 249/193 |

*Primary Examiner*—James C. Housel
*Attorney, Agent, or Firm*—Wm. Bruce Day

[57] ABSTRACT

A locking hinge mechanism for concrete forms includes parallel hinge strips connected together by hinges positioned at intervals along the length of the strips. Each hinge includes provision for a wedge lock which, when fully inserted, positions the hinge strips at a secure 90° angle. The hinge strips are spaced apart from the juncture of the strips, when arranged at the 90° angle, so that concrete flashings do not clog the hinge. The hinge strips are in turn affixed to the side rails of the joining concrete forms to form a 90° angle, such as for a column form arrangement.

6 Claims, 3 Drawing Sheets

LOCKING HINGE MECHANISM

Field of the Invention

This invention relates to concrete form panels, and particularly to hinges for holding concrete form panels together in a corner arrangement.

Background of the Invention

Concrete form panels are often arranged together in a 90° or corner relationship. Particularly, when concrete form panels are used to create column forms, as in multi-story building construction, each side of the column is ordinarily one panel wide and may be up to several columns high. When concrete is poured into the column form, the hydrostatic pressure at the base becomes quite significant and tends to force apart the forms, allowing concrete to ooze between the joints. This concrete flashing tends to dry in the hinge joints, making operation for subsequent uses difficult. Particularly, when ordinary piano hinge types of hinges are used, the problem becomes particularly acute, as these hinges are prone to clogging and binding. There are several arrangements for holding concrete forms together but none are seen to be particularly useful with modern frame and panel types of concrete forms.

The present invention provides a locking hinge mechanism which includes parallel hinge strips connected together by hinges positioned at intervals along the length of the strips. Each hinge includes provision for a wedge lock which, when fully inserted, positions the hinge strip at a secure 90° or other selected angle. The hinge strips are in turn affixed to the side rails of adjoining concrete forms to form a selected angle, such as for a column form arrangement.

Objects of the Invention

The objects of the present invention are to provide a locking hinge mechanism for concrete forms which may be opened for cleaning and to remove any flashing that have escaped during the pouring operation; to provide such a locking hinge mechanism which provides a rigid connection between adjacent form panels; to provide such a locking hinge mechanism having parallel hinge strips which may be swung together to form a rigid 90° angle; to provide a locking hinge mechanism in which the interconnecting hinge portions are spaced from a joint between the parallel hinge strips so that the concrete flashings do not clog the hinges; and to provide such a locking hinge mechanism which is simple to manufacture and inexpensive to purchase.

Other objects and advantages of the present invention will become apparent from the following description taken in connection with the accompanying drawings, wherein is set forth by way of illustration and example, a preferred embodiment of this invention and the best mode currently known to the inventor for carrying out the invention.

Detailed Description of the Preferred Embodiment

Figure 1:
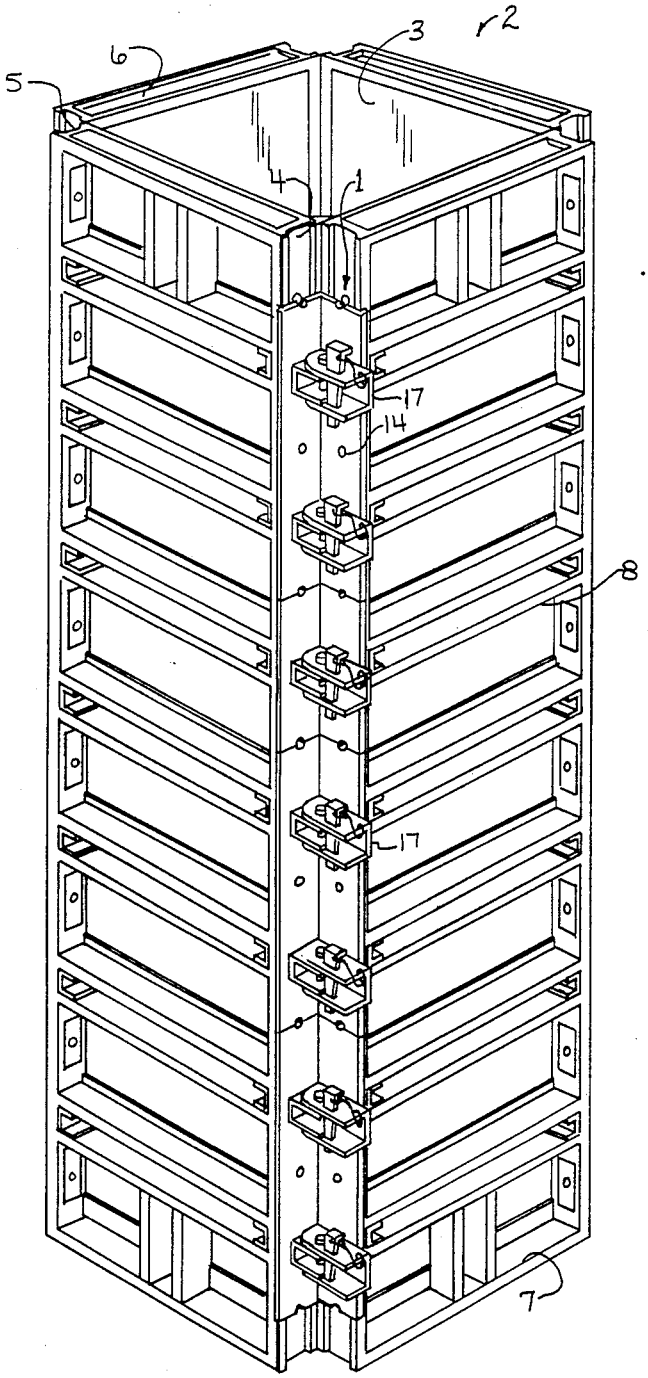
FIG. 1 is a perspective view of a column form arrangement showing the concrete form panels with one corner joined by a locking hinge mechanism embodying the present invention.

As required, a detailed embodiment of the present invention are disclosed herein. It is, however, to be understood that the disclosed embodiment is merely illustrative of the invention, which may be embodied in various forms. Therefore, specific structural and functional details disclosed herein are not to be interpreted as limiting, but merely to provide the proper basis for the claims and as a representative basis for teaching one skilled in the art to employ the locking hinge mechanism disclosed herein in virtually any appropriately specific and detailed structure.

A locking hinge mechanism, generally indicated at 1, may be used with our concrete form panel 2, which has the configuration generally as shown in our U.S. Pat. No. 4,744,541, incorporated by reference herein. The form panel 2 generally includes a face panel 3, spaced side rails 4 and 5 and top and bottom rails 6 and 7. Interspersed at intervals along the form panel 2 are crossrails 8 for strengthening and rigidity against bending.

When used for a column form application, the form panel 2 is often approximately two feet wide and eight feet high. Form panels 2 can be stacked atop each other for columns of greater than eight foot height. Substantial hydrostatic pressure can accumulate at the bottom of the form panels 2 and concrete flashing can escape between the joints or joining mechanisms used to secure the adjoining panels together. Upon drying, the concrete flashings may clog hinges used to hold the form panels together, particularly if those hinges are the piano type hinge which is commonly used.

Figure 2:
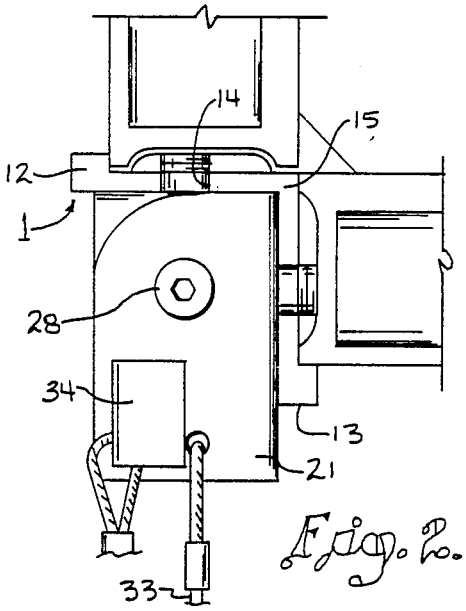
FIG. 2 is a fragmentary view of a corner portion of a column form arrangement showing a plan view of the locking hinge mechanism.
Figure 3:
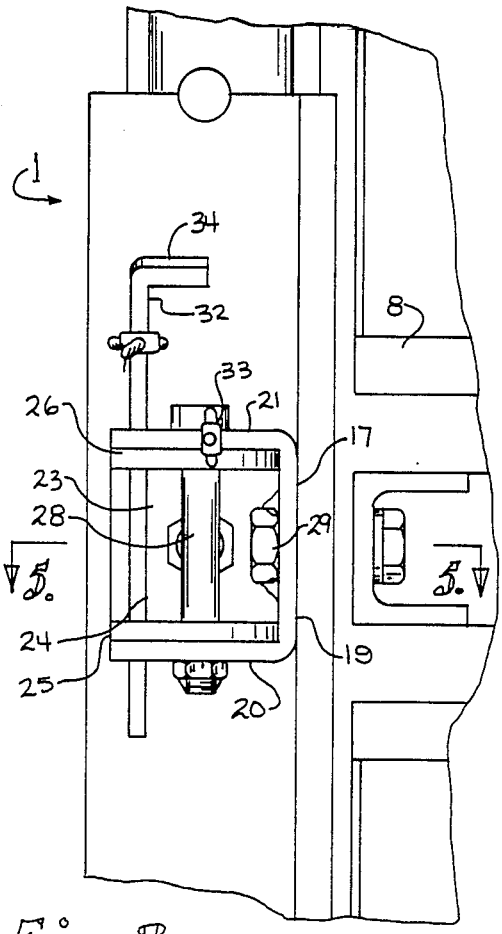
FIG. 3 is a fragmentary view of a corner portion of a column in form arrangement showing an elevational view of the locking hinge mechanism.

In the illustrated example, the locking hinge mechanism includes spaced, parallel hinge strips 12 and 13, FIGS. 2 and 3, each of the strips 12 and 13 may be of the same full length as the side rails 4 and 5, or may be of a shorter length so that several locking hinge mechanisms are stacked together to extend the full length of the form panel side rails 4 and 5 as shown in FIG. 1. Further, each of the strips 12 and 13 is approximately the same width as the side rails 4 or 5 and have overhanging lip portions $12^1$ to $13^1$ to aid in positioning against the side rails 4 and 5. Positioned at intervals along the strips 12 and 13 are apertures 14 for attachment of the strips 12 and 13 to the side rails, as by bolts 29, wedge pins or other known fastening means in the concrete form art.

If it is desired that the hinge strips 12 and 13 be swung together to form a 90° corner relationship, then the inner edges 15 on the strips 12 and 13 are arranged in a 45° bevel. Other angular bevels may be used for other angular relationships of the strips 12 and 13.

Figure 7:
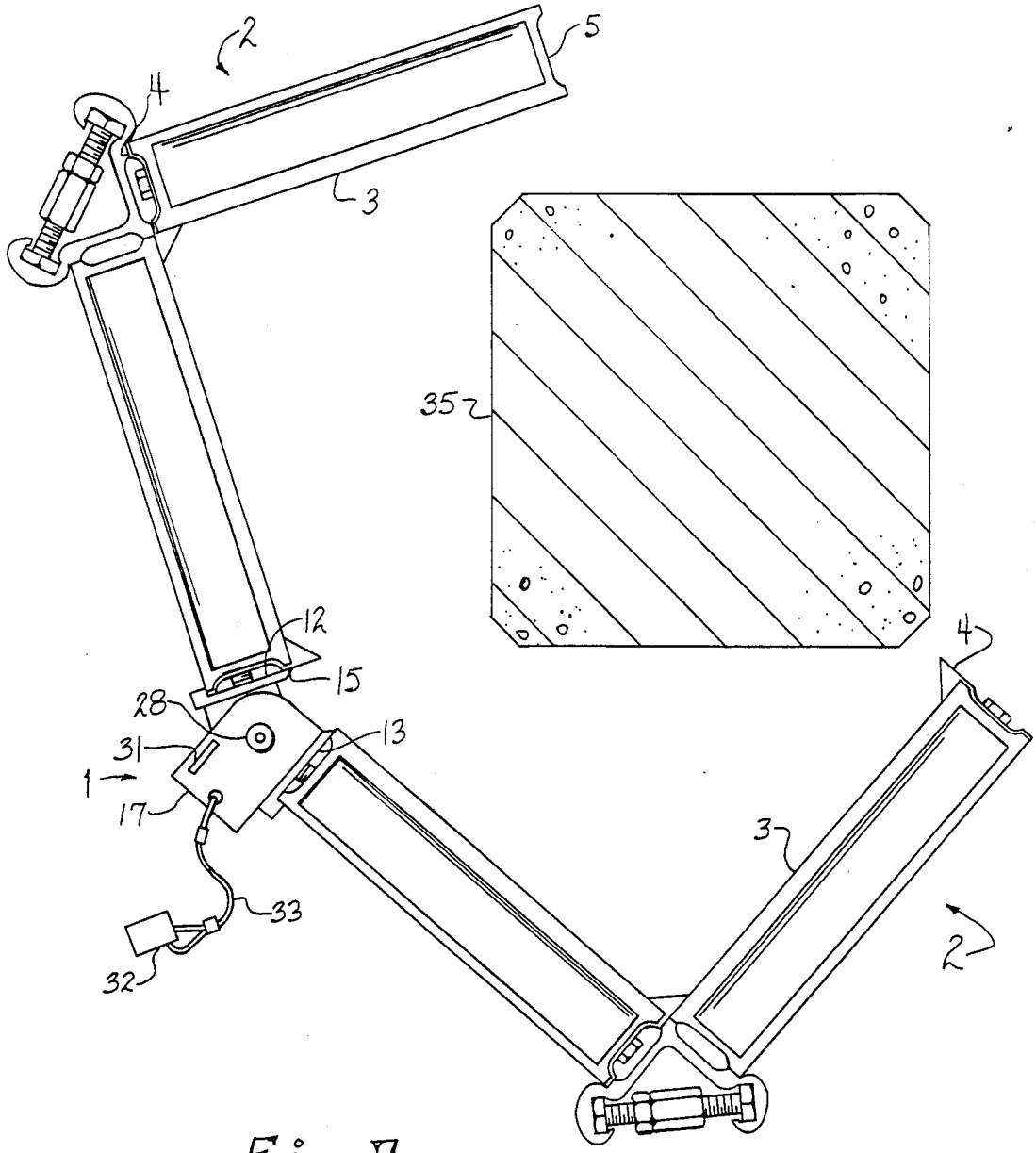
FIG. 7 is a cross sectional view of a column form arrangement showing the form removed from a poured concrete column.

A plurality of hinge assemblies 17 are positioned at intervals along the strips 12 and 13 to hold the strips together. Each hinge assembly 17, in the illustrated example, is formed of hinge halves, including a U-shaped member 18 with a web 19 secured, as by welding, to the surface of the strip 12 or 13 and with spaced flanges 20 and 21 extending normally to the direction of the strip 12 or 13. One such U-shaped member 18 is attached to the strip 13 and another such U-shaped member 23 is affixed to and extends outwardly of the strip 12. The U-shaped member 23 has a web 24 of sufficient width so that its flanges 25 and 26 are sandwiched and closely nest within the U-shaped member 18. U-shaped members 18 and 23 are connected together by a pivot bolt 28. As will be appreciated by viewing FIG. 7, the pivot bolt 28 is spaced from the beveled edges 15 to provide, in an actual embodiment, when the hinges 17 are open, there is a two-inch space between the edges 15 from each of the strips 12 and 13. This gap make it easy to knock off any adhering concrete material.

Figure 4:
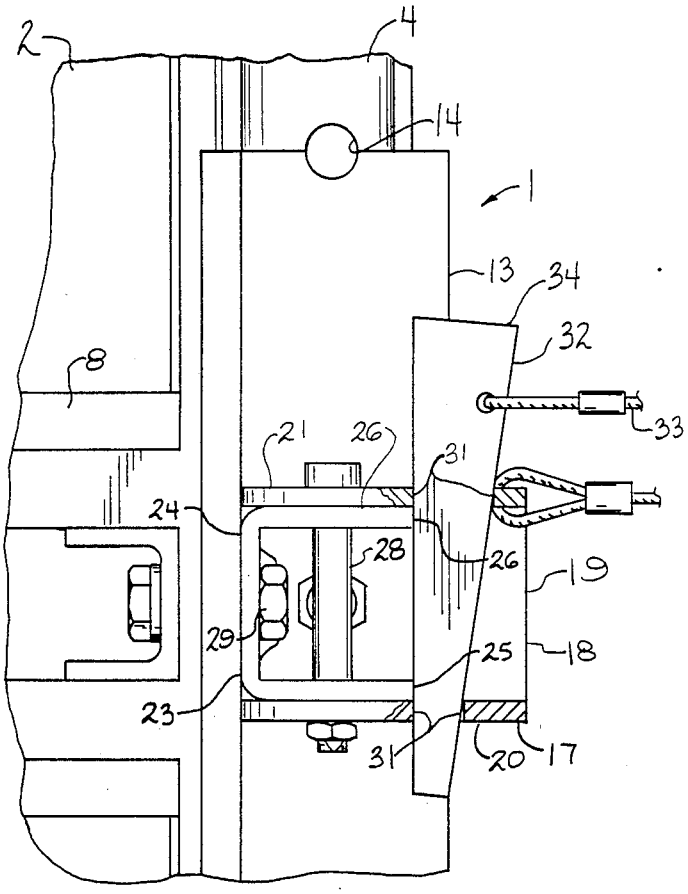
FIG. 4 is a side elevational view of the locking hinge 10 mechanism.
Figure 5:
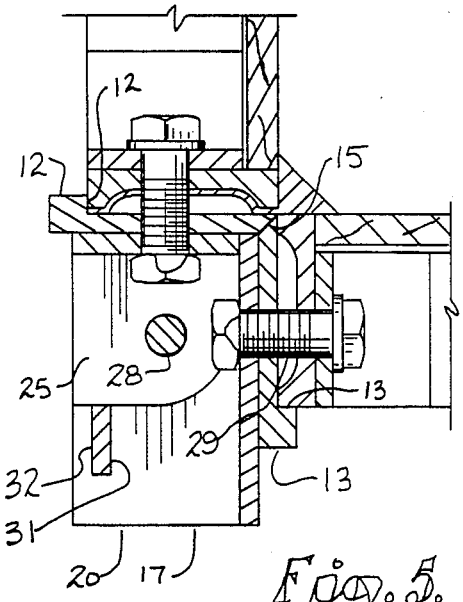
FIG. 5 is a cross sectional view taken along lines 5—5, FIG. 3.
Figure 6:
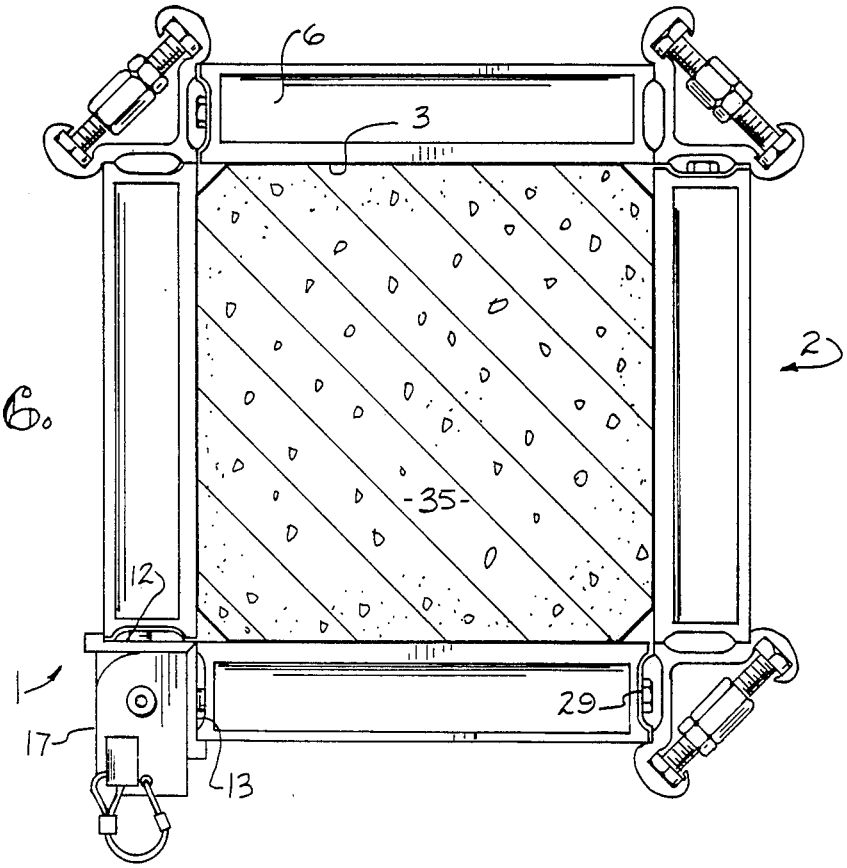
FIG. 6 is a cross sectional view of a column form arrangement showing the form in place about a poured concrete column.

To secure the hinge assemblies 17 in a 90° relationship, FIG. 2, the hinge assemblies 17 include a wedge. In the illustrated example, the flanges 20 and 21 of the U-shaped member 18 have slots 31 there-through. A wedge-shaped pin 32 is secured, as by a tether 33, to the flange 21 and has a head 34 for hammering and driving the wedge pin 32 into contact with the other portion of the hinge assembly, the U-shape member 23. As the wedge pin 32 is driven downwardly, the edge of the pin bears against outer edges $25^1$ and $26^1$ and of the flanges 25 and 26, FIG. 4.

In use, the locking hinge mechanism 1 is secured by extending wedge pins or bolts 29 through the apertures 14 to secure the respective hinge strips 12 and 13 to respective side 10 rails 4 or 5 of adjoining form panels 2. Once in position, the hinge mechanism is fixed at a 90° relationship by inserting the wedge pins 32 in the slots 31 and pounding on the heads 34 thereof until the pins are tight and the inner beveled edges 15 are tight against each other. The wedge pins 32 provide a substantial resistance against opening or separation of the inner beveled edges 15, however, if there is some concrete leakage upon pouring the column 35, the concrete, being spaced from the pivot bolt 28, will not tend to clog and interfere with operation of the locking hinge mechanism 1. After use, the locking hinge mechanism 1 can be opened to the position shown in FIG. 7, any concrete flashings knocked therefrom and then the mechanism 1 is sprayed with a light penetrating oil in preparation for re-use.

It is to be understood that while certain forms of this invention have been illustrated and described, the invention is not limited thereto, except insofar as such limitations are included in the following claims.

What is claimed and desired to be secured by Letters Patent is as follows:

1. A locking hinge mechanism for concrete forms comprising:

a. first and second parallel hinge strips respectively having means for attachment to side rails of adjoining concrete forms;

b. each of said hinge strips having confronting beveled edges at a selected angle for establishing a closed angular relationship of said hinge strips when swung together;

c. a plurality of hinge means offset from said beveled edges and connecting said hinge strips together; and d. each said hinge means including means for wedging said hinges means together to swing said hinge strips together and exerting increasing compressive force on said confronting beveled edges as said means for wedging is advanced, said means for wedging said hinge means affixing said hinge strips to said closed angular relationship.

2. The locking hinge mechanism set forth in claim 1:

a. each of said hinge means including a first hinge portion extending outwardly from said first hinge strip and a second hinge portion extending outwardly from said second hinge strip;

b. said first and second hinge portions having means pivotally connecting said first and second hinge portions together; and c. said means for wedging said hinge means together include slots extending through said first and second hinge portions and a wedge pin insertable through said slots.

3. The locking hinge mechanism set forth in claim 2 wherein:

a. said first and second hinge portions each include upper and lower plates sandwiched together.

4. A locking hinge mechanism for concrete forms comprising:

a. first and second parallel hinge strips respectively having means for attachment to side rails of adjoining concrete forms, each of said strips having side edges movable into intercontact and with 45° bevels for a 90° connection.

b. a plurality of hinge means connecting said hinge strips together, each of said hinge means including spaced upper and lower plates with the upper and lower plates extending outwardly from said first hinge strip receiving the upper and lower plates extending outwardly from said second hinge strip, and having a hinge pin connecting all of said hinge plates together; and c. each of said hinge means having means for wedging said hinge strips into 9020 relationship and including a wedge slot extending through all of said plates and aligned when said hinge strips are arranged substantially in a 90° orientation and a wedge pin tethered to said hinge means for insertion into said slot for rigidly affixing said hinge plates in a 90° relationship.

5. A locking hinge mechanism for concrete forms comprising:

a. first and second parallel hinge strips respectively having means for attachment to side rails of adjoining concrete forms, each of said strips having overhanging lip portions for positioning against said side rails and having side edges movable into intercontact and with 45° bevels for a 90° connection;

b. a plurality of hinge means connecting said hinge strips together, each of said hinge means including spaced upper and lower plates with the upper and lower plates extending outwardly from said first hinge strip receiving the upper and lower plates extending outwardly from said second hinge strip, and having a hinge pin connecting all of said hinge plates together; and c. each of said hinge means having means for wedging said hinge strips into 90° relationship and including a wedge slot extending through all of said plates and aligned when said hinge strips are arranged substantially in a 90° orientation and a wedge pin tethered to said hinge means for insertion into said slot for rigidly affixing said hinge plates in a 90° relationship.

6. A locking hinge mechanism for concrete forms comprising:

a. first and second parallel hinge strips respectively having means for attachment to side rails of adjoining concrete forms;

b. each of said hinge strips having confronting edges at a selected angle for establishing an angular relationship of said hinge strips when swung together;

c. a plurality of hinge means offset from said confronting edges and connecting said hinge strips together; and d. each said hinge means including means for selectively wedging said hinge means together to lock said hinge strips together in a closed position and for wedging said hinge means apart to lock said hinge strips in open, winged relationship; said means for wedging exerting increasing wedging compressive force on said confronting edges as said means for wedging is advanced when locking said hinge strips to said closed position.

* * * * *